US009713758B2

(12) United States Patent
Lefsrud

(10) Patent No.: US 9,713,758 B2
(45) Date of Patent: Jul. 25, 2017

(54) SKI BOOT FRAME

(71) Applicant: Kevin John Lefsrud, Viking (CA)

(72) Inventor: Kevin John Lefsrud, Viking (CA)

( * ) Notice: Subject to any disclaimer, the term of this patent is extended or adjusted under 35 U.S.C. 154(b) by 0 days.

(21) Appl. No.: 15/086,827

(22) Filed: Mar. 31, 2016

(65) Prior Publication Data

US 2016/0206948 A1 Jul. 21, 2016

Related U.S. Application Data

(63) Continuation-in-part of application No. 14/055,767, filed on Oct. 16, 2013.

(51) Int. Cl.
*A63C 9/00* (2012.01)
*A63C 9/02* (2012.01)
*A63C 10/04* (2012.01)

(52) U.S. Cl.
CPC ..... *A63C 9/02* (2013.01); *A63C 9/002* (2013.01); *A63C 10/04* (2013.01); *A63C 2203/50* (2013.01)

(58) Field of Classification Search
None
See application file for complete search history.

(56) References Cited

U.S. PATENT DOCUMENTS 2,764,418 A * 9/1956 Shimizu ..... A63C 9/04 280/614
3,764,155 A * 10/1973 Perryman ..... A63C 9/08 280/618
3,851,892 A * 12/1974 Swenson ..... A63C 9/04 280/615
3,944,237 A * 3/1976 Teague, Jr. ..... A63C 9/001 280/618
4,142,734 A * 3/1979 Bentley ..... A63C 9/002 24/197
4,367,885 A * 1/1983 Ramer ..... A63C 9/00 280/614
4,767,127 A * 8/1988 Olivieri ..... A63C 1/18 24/68 CD
5,577,756 A * 11/1996 Caron ..... A63C 10/08 280/607
5,615,901 A * 4/1997 Piotrowski ..... A43B 5/0468 280/11.19
5,741,023 A * 4/1998 Schiele ..... A63C 9/02 280/14.21
5,815,953 A * 10/1998 Kaufman ..... A43B 5/04 36/117.3
6,527,293 B1 * 3/2003 Roy ..... A63C 13/006 280/619

(Continued)

FOREIGN PATENT DOCUMENTS

DE 19915844 A1 * 10/2000 ..... A63C 5/02
DE 102008006069 A1 * 7/2009 ..... A43B 1/0054

(Continued)

*Primary Examiner* — Emma K Frick
(74) *Attorney, Agent, or Firm* — Richard D. Okimaw

(57) ABSTRACT

Disclosed herein is a boot frame comprising: a) a base; b) two side supports; c) a toe binding; d) a heel binding; e) an ankle support; f) a calf support; and g) at least one strap configured to secure a boot to the boot frame, wherein the side supports are independently adjustable, and wherein adjusting the side supports allows for a boot to line up at an angle relative to the base.

16 Claims, 5 Drawing Sheets

(56) References Cited

U.S. PATENT DOCUMENTS

| | | | | | |
|---|---|---|---|---|---|
| 6,557,865 | B1 * | 5/2003 | Reuss | A43B 5/0401 | 280/14.21 |
| 6,588,773 | B1 * | 7/2003 | Van Riet | A63C 10/04 | 280/14.22 |
| 6,691,434 | B1 * | 2/2004 | Couturier | A43B 5/04 | 36/109 |
| 7,246,811 | B2 * | 7/2007 | Martin | A63C 10/04 | 280/14.22 |
| 7,823,905 | B2 * | 11/2010 | Ritter | A63C 5/02 | 280/14.26 |
| 8,191,918 | B2 * | 6/2012 | Pupko | A63C 9/003 | 280/607 |
| 8,696,013 | B2 * | 4/2014 | Saunders | A63C 10/045 | 280/623 |
| 8,876,123 | B2 * | 11/2014 | Bradshaw | A63C 1/04 | 280/11.3 |
| 2010/0102522 | A1 * | 4/2010 | Kloster | A63C 5/02 | 280/14.24 |
| 2011/0121543 | A1 * | 5/2011 | Lyons | A63C 9/003 | 280/624 |
| 2011/0227317 | A1 * | 9/2011 | Holbird, Jr. | A63C 10/145 | 280/626 |
| 2014/0159345 | A1 * | 6/2014 | Indulti | A63C 9/0805 | 280/614 |
| 2016/0199722 | A1 * | 7/2016 | Ritter | A63C 9/10 | 280/617 |

FOREIGN PATENT DOCUMENTS

| | | | | |
|---|---|---|---|---|
| DK | WO 02/00313 | A1 * | 1/2002 | |
| DK | WO 0200313 | A1 * | 1/2002 | A63C 1/26 |
| FR | 2414342 | A1 * | 8/1979 | A63C 9/00 |
| FR | 2655870 | A1 * | 6/1991 | A63C 9/00 |

* cited by examiner

SKI BOOT FRAME

CROSS REFERENCE TO RELATED APPLICATION

This application is a continuation-in-part of applicant's co-pending application Ser. No. 14/055,767, filed Oct. 16, 2013, the entire contents of which is hereby expressly incorporated by reference herein.

FIELD OF THE INVENTION

The present invention is in the field of ski and snowboard boots, and specifically in the field of ski boot and ski binding accessories.

BACKGROUND OF THE DISCLOSURE

Ski boots are generally uncomfortable whereas snowboard boots provide more long lasting comfort for the wearer. The outer shell of ski boots is comprised of hard plastic and is thus makes the boot difficult to maneuver in when not latched into skis. The flexible leather that comprises the synthetic shell of a snowboard boot provides more comfort and motility. The thick hard soles of ski boots can be ruined once worn off of the snow and restrict cushioning on the feet. The soles of snowboarding boots are similar to those of athletic shoes, which allows them to be more versatile as well as provides more cushioning for the feet. Many skiers have switched to snowboarding due to the more comfortable boot.

SUMMARY OF THE INVENTION

Disclosed herein is a boot frame comprising: a) a base; b) two side supports; c) a toe binding; d) a heel binding; e) an ankle support; f) a calf support; and g) at least one strap configured to secure a boot to the boot frame, wherein the side supports are independently adjustable, and wherein adjusting the side supports allows for a boot to line up at an angle relative to the base.

DETAILED DESCRIPTION OF THE EMBODIMENTS

The following is a detailed description of certain specific embodiments of the boot frames disclosed herein. In this description reference is made to the drawings.

In one aspect, disclosed herein is a boot frame comprising: a) a base; b) two side supports; c) a toe binding; d) a heel binding; e) an ankle support; d) a calf support; and e) at least one strap configured to secure a boot to the boot frame, wherein the side supports are independently adjustable, wherein adjusting the side supports allows for a boot to line up at an angle relative to the base, and wherein the base is comprised of iron, steel, titanium, composite metal, wood, plastic, carbon fiber, fiber glass, hard plastic, rubber or combinations thereof.

Figure 1:
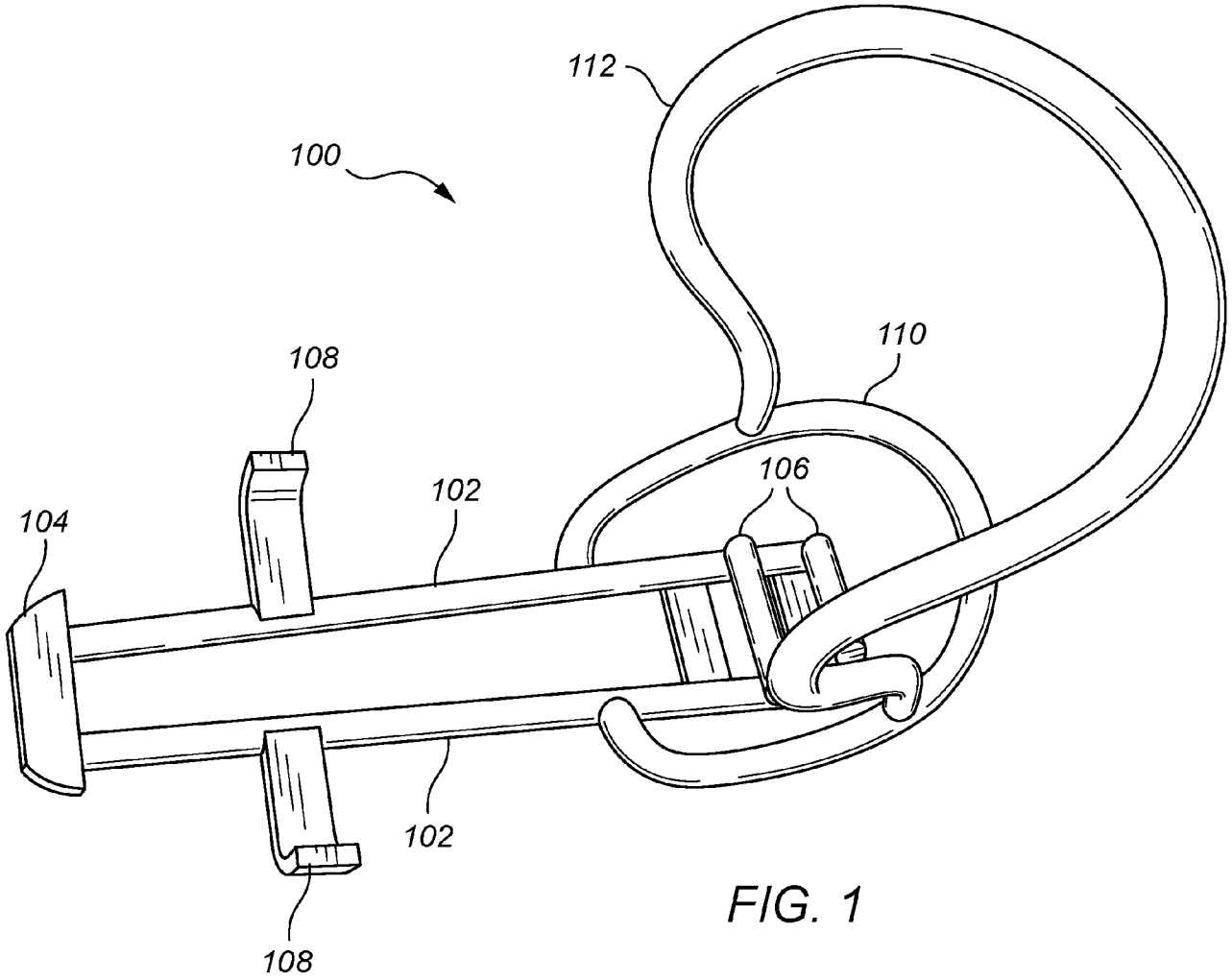
FIG. 1 is a top view showing the components of an embodiment of a ski boot frame.
Figure 2:
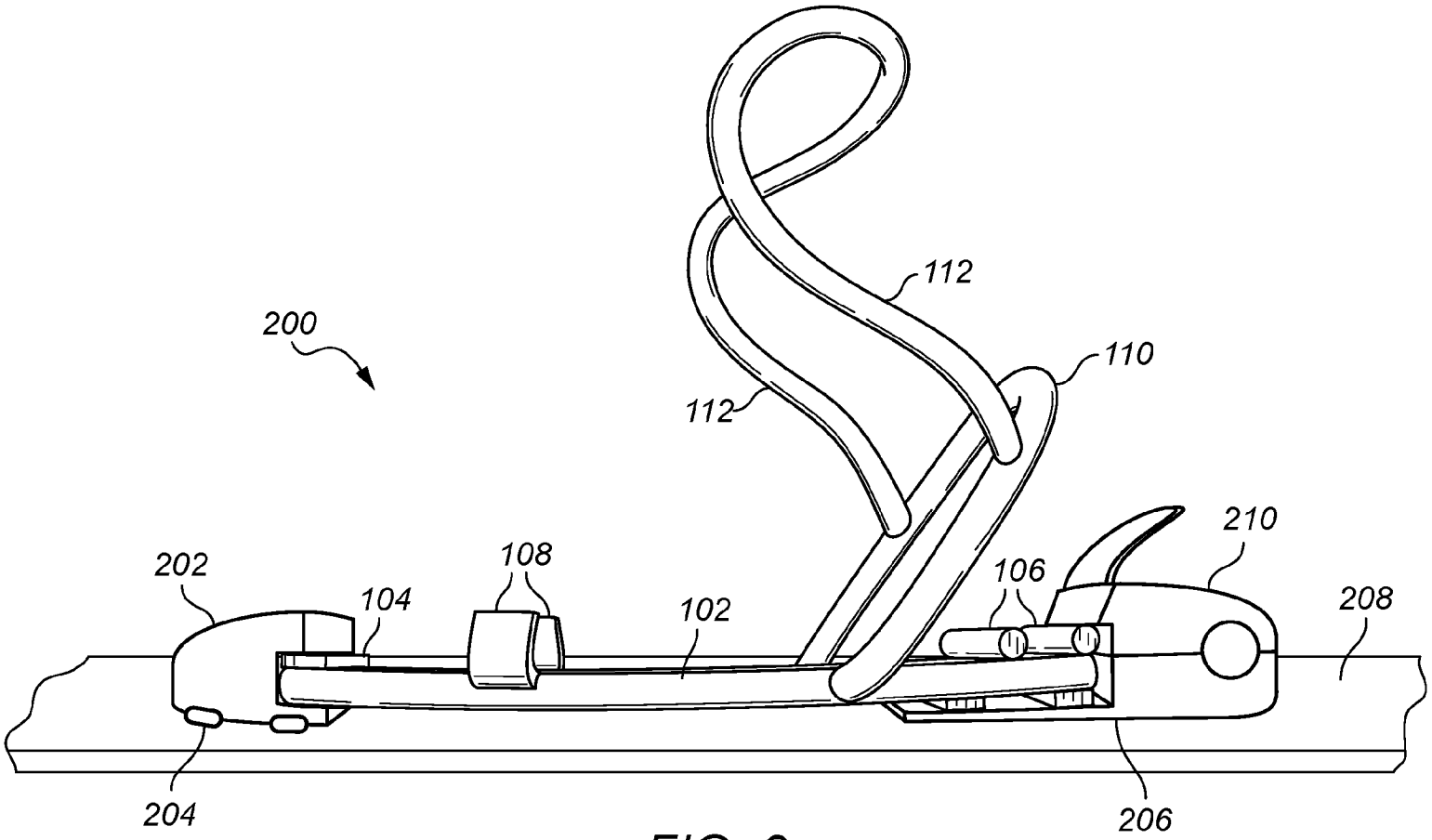
FIG. 2 is a side view showing the components of an embodiment of a ski boot frame.

Referring to FIGS. 1 and 2, disclosed herein is a boot frame 100. The frame 100 comprises a base 102. As shown in FIG. 1, the base 102 comprises two substantially parallel bars. In some embodiments, the base comprises two substantially parallel bars. In some embodiments the bars are present in various quantities and positions. For example, in some embodiments the bars are not parallel. In other embodiments, the bars intersect. In some embodiments, the base 102 is a solid piece, whereas in other embodiments it is a perforated piece. Some embodiments are comprised of a single bar and other embodiments are comprised of multiple, e.g. more than two, bars. In some embodiments, the boot frame is comprised of iron, steel, titanium, composite metal, wood, plastic, carbon fiber, fiber glass, hard plastic, rubber or combinations thereof. In some embodiments base 102 is made of a metal. Examples of metals include those that are strong enough to hold the boot to skis and not bend under pressure. These examples include, but are not limited to, iron, steel, titanium, and composite metals. In certain embodiments, base 102 is made of wood. In other embodiments, base 102 is made of a synthetic material, such as, but not limited to, plastics, carbon fiber, fiber glass, and the like.

In some embodiments, the base 102 has an adjustable length. In these embodiments the base 102 comprises two interconnected pieces, a front piece and a rear piece. When the length of the base 102 is adjusted, the front of the base 102 moves closer to, or further away, from the rear of the base 102. The adjustable length allows the user to adjust the frame 100 to fit the user's boot size. In other embodiments, the base 102 has a fixed length. In these embodiments, frames 100 of various lengths are manufactured and the user uses a frame 100 that fits the user's boot size.

The base 102 comprises a toe binding 104 at the front end of the frame 100. The toe binding 104 is configured to secure the frame 100 into an alpine toe ski binding 204 which is mounted to the alpine ski via mounts 204 the way a typical ski boot would latch in. As shown in FIG. 1, the toe binding 104 comprises a small piece of hard material in the shape of a trapezoid. In some embodiments the toe binding 104 is present in different shapes, including but not limited to, a square, oval, or rectangular shape. The shape of the toe binding 104 is dependent on the type of ski binding used on skis, i.e., the toe binding 104 is shaped to match the binding of the skis. In some embodiments, the toe binding 104 comprises metal. In certain embodiments the toe binding is made of one or more material including, but not limited, to iron, steel, titanium, composite metals, wood, a synthetic material, such as, but not limited to, plastics, carbon fiber, fiber glass, and the like, hard plastic or rubber. In some embodiments, the toe binding is configured to engage the boot frame with an alpine ski binding on a ski. In some embodiments, a top surface of the toe binding is higher than a top surface of the base. In some embodiments, the toe binding is comprised of iron, steel, titanium, composite metal, wood, plastic, carbon fiber, fiber glass, hard plastic, rubber or combinations thereof. In some embodiments, the heel binding is configured to engage the boot frame with an alpine ski binding on a ski. In some embodiments, for example, as shown in FIG. 2, the top surface of toe binding 104 is higher than the base 102 of the frame 100. In these embodiments, the raised toe binding 104 provides a snug fit for a boot when the boot is placed in the frame 100. In other embodiments, a boot has a corresponding binding at the toe area and the boot binding latches into the toe binding 104.

The base 102 comprises a heel binding 106 at the rear end of the frame 100. The heel binding 106 is configured to secure the frame 100 into an alpine heel ski binding 210 which is mounted to the alpine ski via mounts 206 the way a typical ski boot would latch in. In some embodiments, the heel binding 106 comprises metal. In certain embodiments the heel binding 106 is made of one or more material including, but not limited, to iron, steel, titanium, composite metals, wood, a synthetic material, such as, but not limited to, plastics, carbon fiber, fiber glass, and the like, hard plastic or rubber. In some embodiments, the heel binding 106 is located at the far rear of the base 102. In other embodiments, the base 102 extends farther to the rear than where the heel binding 106 is located. In some embodiments, the heel binding is comprised of iron, steel, titanium, composite metal, wood, plastic, carbon fiber, fiber glass, hard plastic, rubber or combinations thereof.

The International Standard ISO 5355, "Alpine ski-boots—Requirements and test methods", Fourth edition 2205-07-01, corrected version 2006-03-15, sets forth the requirements of alpine ski boots and test methods. As disclosed with the International Standard ISO 5355, "[t]his International Standard specifies the requirements, test methods and marking of ski-boots which are used with current systems of alpine ski-bindings with attachment at the boot toe and boot heel, the proper release function of which depends on the dimensions and design of the interfaces. For ski-binding systems that function irrespective of the sole shape or that have different requirements for the sole dimensions, it is not always necessary for the ski-boot soles to comply with this International Standard in order to achieve the desired degree of safety." (See The International Standard ISO 5355, "Alpine ski-boots—Requirements and test methods", Fourth edition 2205-07-01, corrected version 2006-03-15 at p. 1). In particular, the International Standard ISO 5355, set forth requirements for the dimensions of a boot toe and heel, which are applicable to the boot frame disclosed herein. In some embodiments, the boot frame meets the requirements of the International Standard ISO 5355. In some embodiments, the heel binding and toe binding each meet the heel and toe dimensional requirements of the International Standard ISO 5355.

In some embodiments, the boot is held in place on the frame 100 by at least two side supports 108. In some embodiments, the boot side supports 108 are connected near the front of the frame 100. In some embodiments they are located towards the rear of the frame 100 or in the middle of the frame 100. In some embodiments the side supports 108 are comprised of solid metal and in some embodiments they are comprised of perforated metal. In certain embodiments the side supports 108 is made of one or more material including, but not limited, to iron, steel, titanium, composite metals, wood, a synthetic material, such as, but not limited to, plastics, carbon fiber, fiber glass, and the like, hard plastic or rubber. In some embodiments the side supports curve around the shape of the boot and in other embodiments the side supports have various shapes including but not limited to vertical and parallel bars. Some embodiments comprise one set of parallel side supports 108. Other embodiments comprise more than one set of parallel side supports 108 for example two or three sets. Some embodiments, for example the one shown in FIG. 3, do not have any side support 108. In some embodiments, the ankle support comprises a curved bar with terminal ends affixed to opposed sides of the base. In some embodiments, the ankle support is comprised of iron, steel, titanium, composite metal, wood, plastic, carbon fiber, fiber glass, hard plastic, rubber or combinations thereof. In some embodiments, the calf support comprises a curved bar with terminal ends affixed to opposed sides of the ankle support. In some embodiments, the calf support is comprised of iron, steel, titanium, composite metal, wood, plastic, carbon fiber, fiber glass, hard plastic, rubber or combinations thereof.

Figure 4:
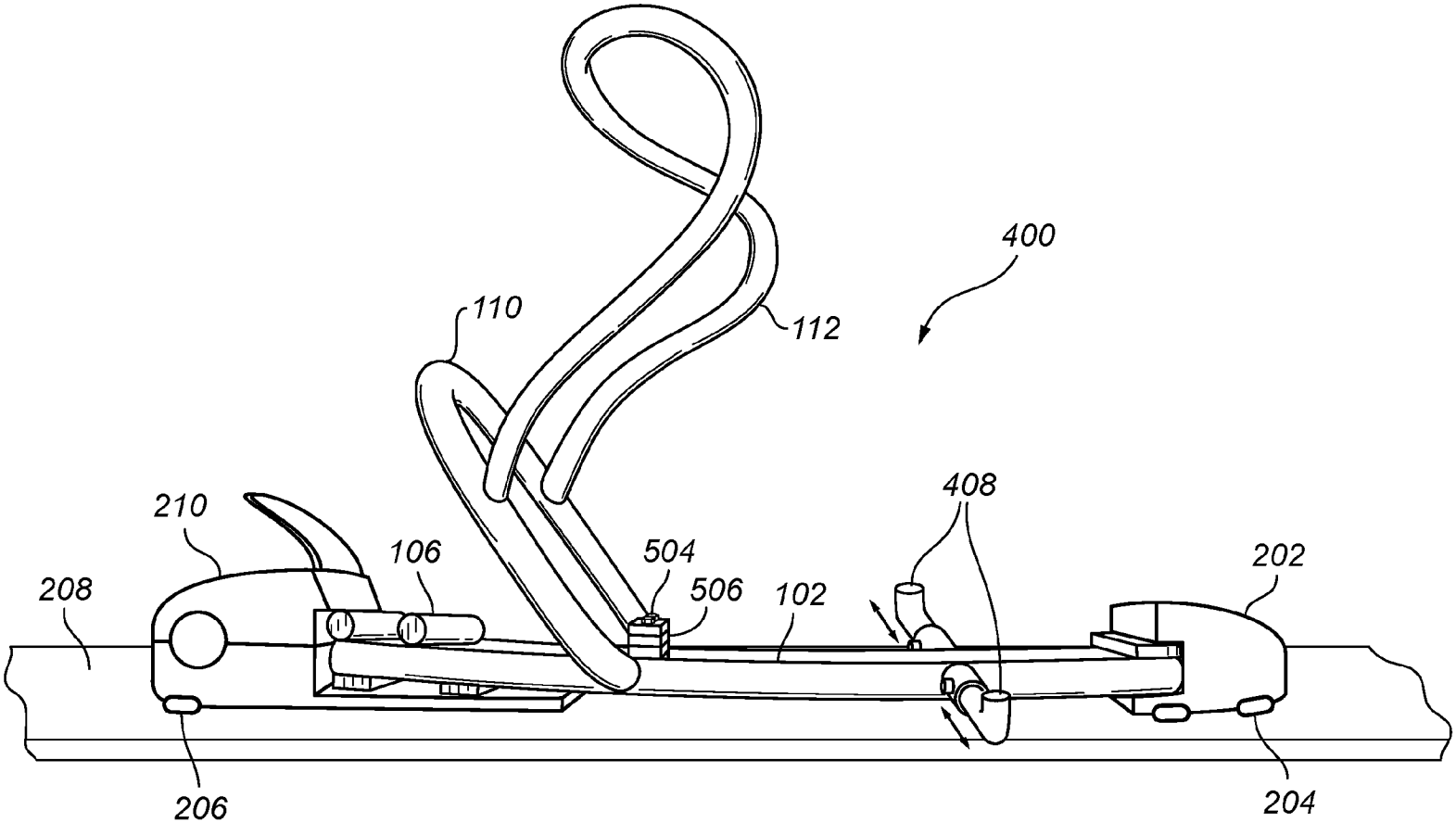
FIG. 4 is a side view showing the components of an embodiment of a ski boot frame.

In some embodiments, for example that shown in FIG. 4, the side supports 408 are adjustable. In these embodiments, the user can move the side supports 408 towards the center of the base 102 or away from the base 102. In some embodiments, the two side supports 408 move together and in the same direction when they are adjusted. In other embodiments, the two side supports 408 move together but in the opposite direction when they are adjusted. In still other embodiments, each side support 108 moves independently.

Often times, when a person stands, the natural inclination of the feet is to either turn in, i.e., with toes facing toward each other and inward, or turn out, i.e., with toes tending away from each other and outward. Regular ski boots force everyone's feet to line up parallel with the skis. This unnatural positioning of the feet puts great pressure on the skier's knees and causes knee and hip injuries over time. By adjusting the side supports 408, a skier can allow for the boot to line up at an angle to the base 102, which angle is the natural angle of the skier's feet when the skier stands. This way, the base 102 lines up with the skis and the skier's feet rest at their natural and comfortable angle, thereby reducing the pressure on knees and hips.

The boot is held in place at the rear of the frame 100 by an ankle support 110. In some embodiments the ankle support 110 comprises a curved bar that is connected to either side of the base 102. In other embodiments the ankle support 110 comprises various bars are connected to either side of the base 102, for example, two bars intersecting each other, multiple bars attached vertically from the base of the base 102, or multiple curved bars attached starting from the heel leading up to the ankle. In some embodiments the ankle support 110 comprises metal for example a solid or perforated metal. In certain embodiments the ankle support 110 is made of one or more material including, but not limited, to iron, steel, titanium, composite metals, wood, a synthetic material, such as, but not limited to, plastics, carbon fiber, fiber glass, and the like, hard plastic or rubber.

In some embodiments, a calf support 112 is connected to the ankle support 110. The calf support 112 can be attached anywhere from the front to the rear of the ankle support 110. In some embodiments the calf support 112 comprises a curved metal bar attaching to either side of the ankle support 110. In other embodiments the calf support 112 comprises various bars attaching to either side of the ankle support 110, for example, two or more bars intersecting each other, multiple bars attached vertically from the base of the frame 102 or base of the ankle support 110, or multiple curved bars attached starting from the top of the ankle leading up to the calf. In some embodiments the calf support 112 comprises metal for example a solid or perforated metal. In certain embodiments the calf support 112 is made of one or more material including, but not limited, to iron, steel, titanium, composite metals, wood, a synthetic material, such as, but not limited to, plastics, carbon fiber, fiber glass, and the like, hard plastic or rubber.

Figure 3:
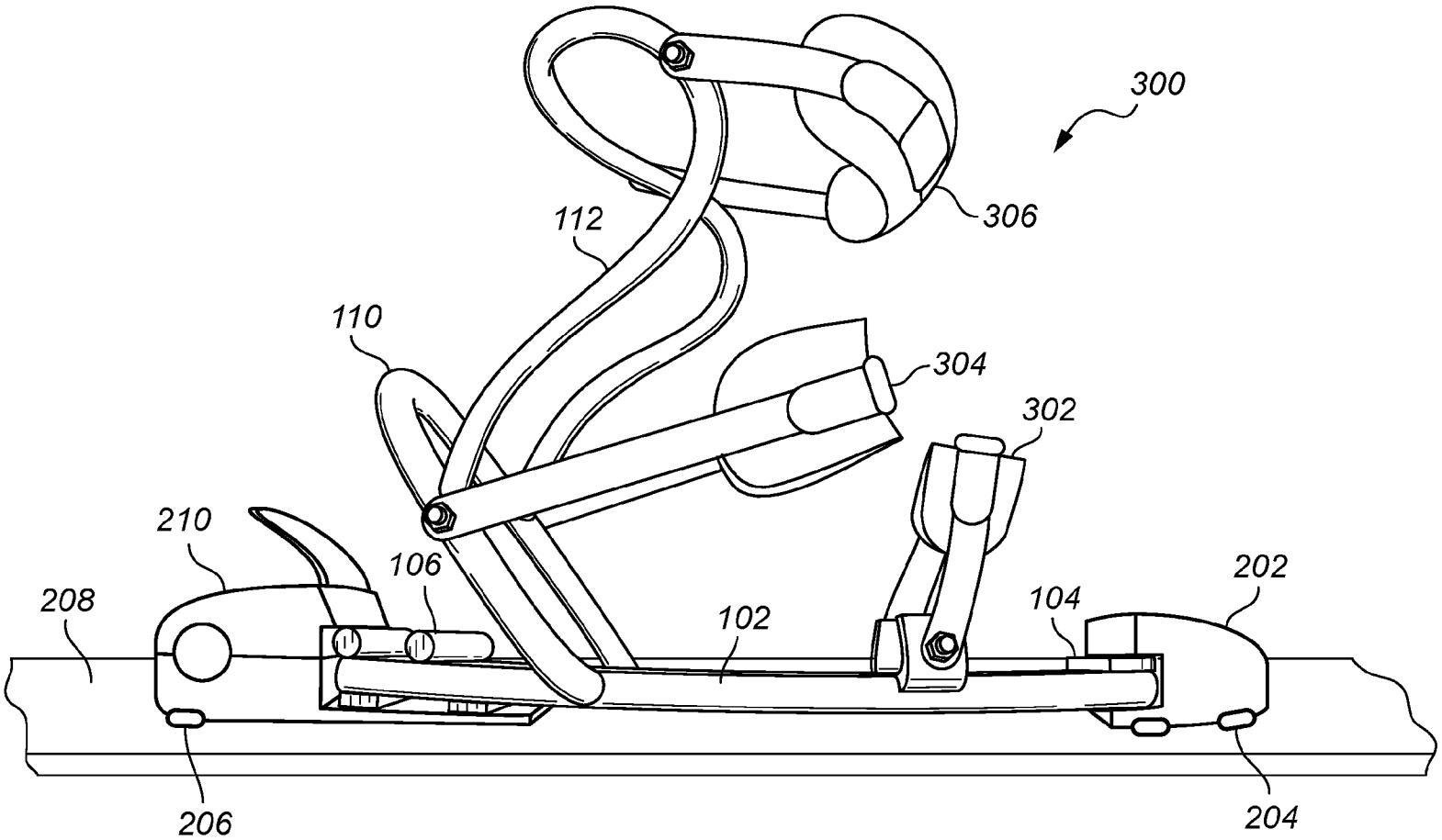
FIG. 3 is a top view showing the components of an embodiment of a ski boot frame with detachable components.

Referring to FIG. 3, in order to keep the boot attached to the frame 100, some embodiments include boot straps located at, for example, but not limited to, the toe 302, ankle 304, and calf 306. In some embodiments, each of the straps 302, 304, 306 independently comprises various materials including but not limited to plastic, cloth, rubber, Kevlar®, or a combination thereof. In some embodiments, the at least one strap is connected to the side supports. In some embodiments, the at least one strap is connected to the ankle support. In some embodiments, the at least one strap is connected to the calf support. In some embodiments, the boot frame further comprises a toe strap, an ankle strap and a calf trap. In some embodiments the toe strap 302 connects on either side of the frame 102 near the front. In some embodiments, the ankle strap 304 connects to either side of the ankle support 110 near the rear. In other embodiments the ankle strap 304 is located in various locations, for example, connected to either side of the metal frame 102 near the rear. In some embodiments the calf strap 306 is connected to opposite sides of the calf support 112 near the top. In other embodiments the calf strap 306 is attached in various locations, for example, either side of the calf support 112 near the middle or bottom. In some embodiments, each of the straps 302, 304, 306 independently is connected to the frame 100 at one end and is loose at the other end. In these embodiments, after the boot is inserted into the frame 100, the loose end of the strap 302, 304, 306 is then attached to the frame 100 to hold the boot in place. In other embodiments, both ends of each of the straps 302, 304, 306 independently are connected to the frame 100. In these embodiments, after the boot is inserted into the frame 100 the straps 302, 304, 306 are tightened to secure the boot in place.

Figure 5B:
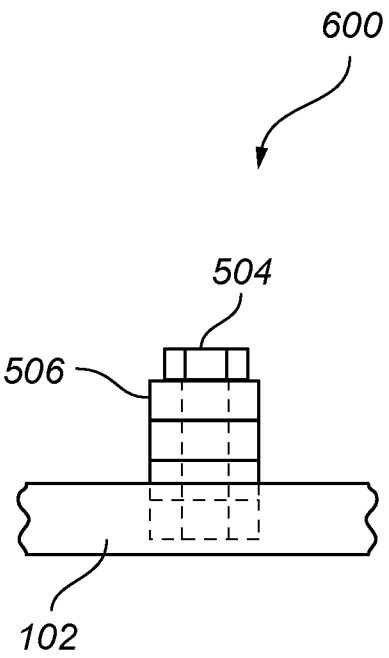
FIG. 5B is a side view illustration of one or more heel height plates.
Figure 5A:
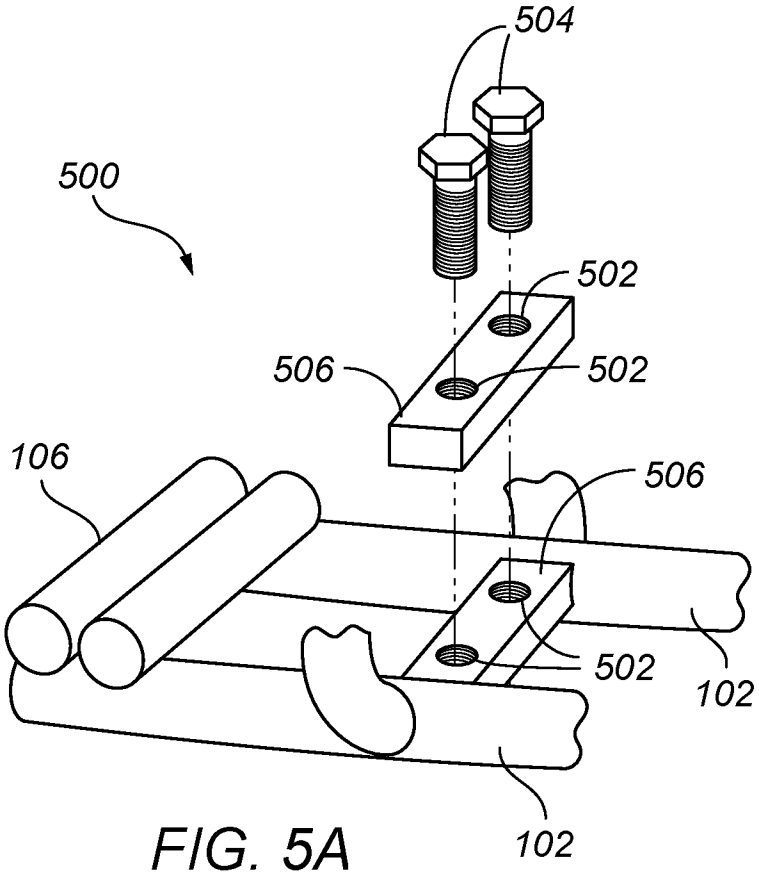
FIG. 5A is an exploded view illustration of one or more heel height plates.

In some embodiments, the height of the heel is adjustable. In an embodiment shown in FIG. 5A, the boot frame 102 further comprises one or more plates 506. The user can add additional plates 506 in the location of the heel binding 106 thereby raising the height of the heel binding 106. In these embodiments, the plates 506 are secured in place using screws 504 that screw into holes 502. In some embodiments, for example the one shown in FIG. 5A, two screws 504 secure the plates 506 in place. In other embodiments, additional screws are used. It is preferable to have at least two screws 504, because a single screw may result in the rotation of the plate 506 in place. FIG. 5B shows a side view of an adjustable heel height portion having four plates 506 held in place by screws 504. In some embodiments, the boot frame further comprises one or more heel height plates.

In other embodiments (not shown), the user can turn a dial that cranks an adjustable heel height portion up or down and adjusts it to the desired height. By changing the height of the heel the user raises or lowers the height of the boot heel, which results in a more comfortable stance on the skis and provides greater control while skiing.

Definitions

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

The term "front" refers to the area where the toe section of a boot would fit in the disclosed device, and "rear" refers to the area where the heel section of a boot would fit in the disclosed device. FIG. 1 shows a schematic drawing of one embodiment of devices disclosed herein. The devices are described with reference to FIG. 1, but those of skill in the art recognize that variations, including those described herein, are still within the scope of the present disclosure.

The term "boot" refers to a snowboard boot, hiking boot, high top sneaker, work boot, etc.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

While certain embodiments have been illustrated and described, it should be understood that changes and modifications can be made therein in accordance with ordinary skill in the art without departing from the technology in its broader aspects as defined in the following claims.

The present disclosure is not to be limited in terms of the particular embodiments described in this application. Many modifications and variations can be made without departing from its spirit and scope, as will be apparent to those skilled in the art. Functionally equivalent methods and devices within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods or devices, which can of course vary. It is also to be understood that the terminology used herein is for the purpose of describing particular embodiments only, and is not intended to be limiting.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

What is claimed is:

1. A boot frame comprising:

a) a base;

b) two side supports;

c) a toe binding;

d) a heel binding;

e) an ankle support;

f) a calf support; and g) at least one strap configured to secure a boot to the boot frame, wherein the side supports are independently adjustable, and wherein adjusting the side supports allows for a boot to line up at an angle relative to the base, wherein the toe binding is configured to engage the boot frame with an alpine ski binding on a ski, wherein the base comprises two substantially parallel base bars, each bar having a circular sleeve protruding from an outer lateral surface of the respective base bar, and wherein each side support comprises a an L-shaped bar slidably positioned within the respective sleeve.

2. The boot frame of claim 1, wherein the frame is comprised of iron, steel, titanium, composite metal, wood, plastic, carbon fiber, fiber glass, hard plastic, rubber or combinations thereof.

3. The boot frame of claim 1, wherein the base is comprised of iron, steel, titanium, composite metal, wood, plastic, carbon fiber, fiber glass, hard plastic, rubber or combinations thereof.

4. The boot frame of claim 1, wherein a top surface of the toe binding is higher than a top surface of the base.

5. The boot frame of claim 1, wherein the toe binding is comprised of iron, steel, titanium, composite metal, wood, plastic, carbon fiber, fiber glass, hard plastic, rubber or combinations thereof.

6. The boot frame of claim 1, wherein the heel binding is configured to engage the boot frame with an alpine ski binding on a ski.

7. The boot frame of claim 1, wherein the heel binding is comprised of iron, steel, titanium, composite metal, wood, plastic, carbon fiber, fiber glass, hard plastic, rubber or combinations thereof.

8. The boot frame of claim 1, wherein the ankle support comprises a curved bar with terminal ends affixed to opposed sides of the base.

9. The boot frame of claim 1, wherein the ankle support is comprised of iron, steel, titanium, composite metal, wood, plastic, carbon fiber, fiber glass, hard plastic, rubber or combinations thereof.

10. The boot frame of claim 1, wherein the calf support comprises a curved bar with terminal ends affixed to opposed sides of the ankle support.

11. The boot frame of claim 1, wherein the calf support is comprised of iron, steel, titanium, composite metal, wood, plastic, carbon fiber, fiber glass, hard plastic, rubber or combinations thereof.

12. The boot frame of claim 1, wherein the at least one strap is connected to the side supports.

13. The boot frame of claim 1, wherein the at least one strap is connected to the ankle support.

14. The boot frame of claim 1, wherein the at least one strap is connected to the calf support.

15. The boot frame of claim 1, further comprising a toe strap, an ankle strap and a calf strap.

16. The boot frame of claim 1, further comprising one or more heel height plates.

* * * * *